US007147314B2

(12) United States Patent
Anderson, Jr. et al.

(10) Patent No.: US 7,147,314 B2
(45) Date of Patent: Dec. 12, 2006

(54) SINGLE PIECE FILTRATION FOR AN INK JET PRINT HEAD

(75) Inventors: James Daniel Anderson, Jr., Harrodsburg, KY (US); James Andrew Kerr, Lexington, KY (US); Steven Robert Komplin, Lexington, KY (US); Ann Marie Trebolo, Nicholasville, KY (US); Timothy L. Howard, Lexington, KY (US); John R. Fowler, Nicholasville, KY (US); David E. Greer, Lexington, KY (US); Matthew J. Russell, Stamping Ground, KY (US)

(73) Assignee: Lexmark International, Inc., Lexington, KY (US)

( * ) Notice: Subject to any disclaimer, the term of this patent is extended or adjusted under 35 U.S.C. 154(b) by 137 days.

(21) Appl. No.: 10/465,404

(22) Filed: Jun. 18, 2003

(65) Prior Publication Data

US 2004/0257401 A1 Dec. 23, 2004

(51) Int. Cl.
*B41J 2/175* (2006.01)

(52) U.S. Cl. ..... 347/93

(58) Field of Classification Search ..... 347/84–87, 347/92, 93, 20, 40–44; 137/87.03, 87.04, 137/172

See application file for complete search history.

(56) References Cited

U.S. PATENT DOCUMENTS

| | | | | |
|---|---|---|---|---|
| 3,940,773 | A | 2/1976 | Mizoguchi et al. | 347/68 |
| 4,303,929 | A | 12/1981 | Blanck | 347/86 |
| 4,336,544 | A | 6/1982 | Donald et al. | 347/54 |
| 4,380,018 | A | 4/1983 | Andoh et al. | 347/68 |
| 4,462,428 | A | 7/1984 | Guenther et al. | 137/868 |
| 4,480,259 | A | 10/1984 | Kruger et al. | 347/63 |
| 4,526,459 | A | 7/1985 | Bresnick | 399/320 |
| 4,604,633 | A | 8/1986 | Kimura et al. | 347/7 |
| 4,641,154 | A | 2/1987 | Mikalsen | 347/88 |
| 4,685,185 | A | 8/1987 | Boso et al. | 29/890.1 |
| 4,734,706 | A | 3/1988 | Le et al. | 347/71 |
| 4,734,711 | A | 3/1988 | Piatt et al. | 347/17 |
| 4,860,787 | A | 8/1989 | Grosselin | 137/487.5 |
| 4,910,529 | A | 3/1990 | Regnault | 347/6 |
| 4,914,453 | A | 4/1990 | Kanayama et al. | 347/86 |
| 5,040,002 | A | 8/1991 | Pollacek et al. | 347/87 |
| 5,126,755 | A | 6/1992 | Sharpe et al. | 347/54 |
| 5,187,498 | A * | 2/1993 | Burger | 347/86 |
| 5,367,328 | A * | 11/1994 | Erickson | 347/7 |
| 5,440,333 | A | 8/1995 | Sykora et al. | 347/87 |
| 5,451,995 | A | 9/1995 | Swanson et al. | 347/87 |
| 5,541,632 | A | 7/1996 | Khodapanah et al. | 347/87 |
| 5,574,490 | A | 11/1996 | Gragg et al. | 347/87 |

(Continued)

*Primary Examiner*—An H. Do
(74) *Attorney, Agent, or Firm*—Taft, Stettinius & Hollister LLP

(57) ABSTRACT

A multi-chamber inkjet print head includes a plurality of individual print head ink chambers that share a common ink filter and are in fluid communication with an ink flow regulator. An associated method of assembling a print head base having at least two separate fluid conduit paths filtered by a single piece of filter includes the steps of: (a) positioning a single piece filter between at least two separate ink receptacles associated with a print head and at least two respective ink conduits; and (b) sealing at least two separate ink paths between the at least two separate ink receptacles associated with the print head and the at least two ink conduits, such that the single piece of filter is in concurrent fluid communication with the at least two separate ink paths.

7 Claims, 13 Drawing Sheets

U.S. PATENT DOCUMENTS

| | | | | | |
|---|---|---|---|---|---|
| 5,583,545 | A | | 12/1996 | Pawlowski, Jr. et al. | 347/7 |
| 5,594,483 | A | | 1/1997 | Kaplinsky et al. | 347/87 |
| 5,610,643 | A | | 3/1997 | Kutami et al. | 347/54 |
| 5,644,341 | A | | 7/1997 | Fujii et al. | 347/11 |
| 5,646,666 | A | | 7/1997 | Cowger et al. | 347/87 |
| 5,650,811 | A | | 7/1997 | Seccombe et al. | 347/85 |
| 5,666,141 | A | | 9/1997 | Matoba et al. | 347/54 |
| 5,686,947 | A | * | 11/1997 | Murray et al. | 347/85 |
| 5,719,609 | A | | 2/1998 | Hauck et al. | 347/85 |
| 5,736,992 | A | | 4/1998 | Pawlowski, Jr. | 347/7 |
| 5,737,001 | A | | 4/1998 | Taylor | 347/85 |
| 5,745,137 | A | | 4/1998 | Scheffelin et al. | 347/85 |
| 5,751,319 | A | | 5/1998 | Robertson et al. | 347/85 |
| 5,757,401 | A | | 5/1998 | Abe et al. | 347/48 |
| 5,757,406 | A | | 5/1998 | Kaplinsky et al. | 347/87 |
| 5,771,053 | A | | 6/1998 | Merrill | 347/86 |
| 5,777,647 | A | | 7/1998 | Pawlowski, Jr. et al. | 347/86 |
| 5,781,213 | A | | 7/1998 | Ujita et al. | 347/86 |
| 5,812,163 | A | | 9/1998 | Wong | 347/68 |
| 5,812,168 | A | | 9/1998 | Pawlowski, Jr. et al. | 347/92 |
| 5,821,966 | A | | 10/1998 | Schell et al. | 347/86 |
| 5,825,383 | A | | 10/1998 | Abe et al. | 347/54 |
| 5,838,351 | A | | 11/1998 | Weber | 347/85 |
| 5,844,577 | A | | 12/1998 | Pawlowski, Jr. | 347/6 |
| 5,847,734 | A | | 12/1998 | Pawlowski, Jr. | 347/86 |
| 5,894,316 | A | | 4/1999 | Sakai et al. | 347/54 |
| 5,912,688 | A | | 6/1999 | Gragg et al. | 347/86 |
| 5,923,353 | A | | 7/1999 | Boyd et al. | 347/85 |
| 5,975,686 | A | | 11/1999 | Hauck et al. | 347/85 |
| 5,980,028 | A | | 11/1999 | Seccombe | 347/85 |
| 5,992,986 | A | | 11/1999 | Gyotoku et al. | 347/85 |
| 6,000,785 | A | | 12/1999 | Sakai et al. | 347/54 |
| 6,007,190 | A | | 12/1999 | Murray et al. | 347/86 |
| 6,010,211 | A | | 1/2000 | Betschon | 347/86 |
| 6,019,465 | A | * | 2/2000 | Shinada et al. | 347/93 |
| 6,074,043 | A | | 6/2000 | Ahn | 347/54 |
| 6,079,813 | A | | 6/2000 | Tuli | 347/54 |
| 6,084,617 | A | | 7/2000 | Balazer | 347/86 |
| 6,084,618 | A | * | 7/2000 | Baker | 347/93 |
| 6,106,180 | A | | 8/2000 | Anderka | 401/145 |
| 6,130,690 | A | | 10/2000 | Ahn | 347/54 |
| 6,130,694 | A | | 10/2000 | Beatty | 347/85 |
| 6,164,744 | A | | 12/2000 | Froger et al. | 347/7 |
| 6,168,267 | B1 | | 1/2001 | Komplin | 347/86 |
| 6,183,071 | B1 | | 2/2001 | Sugimoto et al. | 347/85 |
| 6,199,977 | B1 | | 3/2001 | Komplin et al. | |
| 6,203,146 | B1 | | 3/2001 | Pawlowksi, Jr. et al. | 347/85 |
| 6,206,515 | B1 | | 3/2001 | Swanson et al. | 347/87 |
| 6,217,153 | B1 | | 4/2001 | Silverbrook | 347/54 |
| 6,217,157 | B1 | | 4/2001 | Yoshihira et al. | 347/65 |
| 6,227,654 | B1 | | 5/2001 | Silverbrook | 347/54 |
| 6,228,050 | B1 | | 5/2001 | Olsen et al. | 604/93.01 |
| 6,243,115 | B1 | | 6/2001 | Baker et al. | 347/85 |
| 6,247,791 | B1 | | 6/2001 | Silverbrook | 347/54 |
| 6,250,747 | B1 | | 6/2001 | Hauck | 347/86 |
| 6,257,699 | B1 | | 7/2001 | Tracy et al. | 347/40 |
| 6,257,714 | B1 | | 7/2001 | Seccombe | 347/92 |
| 6,260,961 | B1 | | 7/2001 | Seu et al. | 347/87 |
| 6,270,204 | B1 | | 8/2001 | Barrett et al. | 347/74 |
| 6,273,151 | B1 | | 8/2001 | Kong | 141/18 |
| 6,290,348 | B1 | | 9/2001 | Becker et al. | 347/87 |
| 6,312,116 | B1 | | 11/2001 | Underwood et al. | 347/86 |
| 6,312,615 | B1 | | 11/2001 | Silverbrook | 216/27 |
| 6,318,851 | B1 | | 11/2001 | Hoen et al. | 347/92 |
| 6,325,354 | B1 | | 12/2001 | Hoen et al. | 251/65 |
| 6,328,421 | B1 | | 12/2001 | Kojima et al. | 347/46 |
| 6,331,050 | B1 | | 12/2001 | Nakata et al. | 347/65 |
| 6,331,054 | B1 | | 12/2001 | Seu et al. | 347/87 |
| 6,341,853 | B1 | | 1/2002 | Scheffelin et al. | 347/87 |
| 6,364,471 | B1 | | 4/2002 | Seccombe | 347/85 |
| 6,365,701 | B1 | | 4/2002 | Hayashi et al. | 528/75 |
| 6,371,605 | B1 | | 4/2002 | Komplin et al. | |
| 6,382,784 | B1 | | 5/2002 | Pawlowski, Jr. et al. | 347/85 |
| 6,390,603 | B1 | | 5/2002 | Silverbrook | 347/54 |
| 6,412,911 | B1 | | 7/2002 | Hilton et al. | 347/49 |
| 6,416,165 | B1 | | 7/2002 | Meyer et al. | 347/49 |
| 6,422,691 | B1 | | 7/2002 | Kobayashi et al. | 347/86 |
| 6,428,140 | B1 | | 8/2002 | Cruz-Uribe | 347/20 |
| 6,428,141 | B1 | | 8/2002 | McElfresh et al. | 347/40 |
| 6,428,147 | B1 | | 8/2002 | Silverbrook | 347/54 |
| 6,435,675 | B1 | * | 8/2002 | Okura et al. | 347/86 |
| 6,460,778 | B1 | | 10/2002 | Silverbrook | 238/102.1 |
| 6,478,406 | B1 | | 11/2002 | Silverbrook | 347/54 |
| 6,500,354 | B1 | | 12/2002 | Lee et al. | 216/27 |
| 6,508,545 | B1 | | 1/2003 | Dowell et al. | 347/85 |
| 6,527,357 | B1 | | 3/2003 | Sharma et al. | 347/17 |
| 6,536,875 | B1 | | 3/2003 | Pan | 347/54 |
| 2001/0006395 | A1 | | 7/2001 | Pawlowski, Jr. et al. | 347/85 |
| 2001/0013886 | A1 | | 8/2001 | Underwood et al. | 347/86 |
| 2001/0017641 | A1 | | 8/2001 | Kobayashi et al. | 347/85 |
| 2001/0019347 | A1 | | 9/2001 | Hauck | 347/86 |
| 2001/0030675 | A1 | | 10/2001 | Kobayashi et al. | 347/86 |
| 2001/0040612 | A1 | | 11/2001 | Shimizu | 347/86 |
| 2002/0008744 | A1 | | 1/2002 | Otis et al. | 347/85 |
| 2002/0024573 | A1 | | 2/2002 | Hoen et al. | 347/92 |
| 2002/0036680 | A1 | | 3/2002 | Hall et al. | 347/85 |
| 2002/0039124 | A1 | | 4/2002 | Nanjo et al. | 347/49 |
| 2002/0054194 | A1 | | 5/2002 | Seccombe | 347/86 |
| 2002/0080216 | A1 | | 6/2002 | Dowell et al. | 347/85 |
| 2002/0105567 | A1 | | 8/2002 | Yamada et al. | 347/87 |
| 2002/0145650 | A1 | | 10/2002 | Pan et al. | 347/85 |
| 2002/0186284 | A1 | | 12/2002 | Anma et al. | 347/85 |
| 2002/0191061 | A1 | | 12/2002 | Dowell et al. | 347/94 |
| 2003/0016279 | A1 | | 1/2003 | Hayashi et al. | 347/87 |
| 2003/0052944 | A1 | | 3/2003 | Scheffelin et al. | 347/49 |

* cited by examiner

Fig. 9 from left to right flip from left to right

SINGLE PIECE FILTRATION FOR AN INK JET PRINT HEAD

BACKGROUND

1. Field of the Invention

The present invention is directed to a multi-chamber inkjet print head that includes a plurality of individual print head ink chambers that share a common ink filter and are in fluid communication with an ink flow regulator and an associated method of assembling a print head base having at least two separate fluid conduit paths filtered by a single piece of filter.

2. Background of the Invention

The trend in the printer industry is to make higher resolution images at a faster rate. To do this, printer manufacturers are striving to produce prints with more dots per inch, and to develop a better understanding of dot mixing and color matching. In the case of ink jet printers, much of the control comes from the type of spray port that delivers ink to the receiving medium. The spray ports are extremely small holes through which the ink is forced out and onto the paper. The printer manufacturers can alter the type and number of spray ports. Typical ink jet cartridges may have from approximately 30 to 200 spray ports, and the correct operation of the spray port is critical to the proper operation of the printer. It is therefore important to filter out contamination or agglomerations which may be present in the ink prior to the ink reaching the spray ports.

Ink can be forced out the spray ports using a number of different technologies. The ink can be pressed out by a piezoelectric element which expands with a voltage and compresses the ink, creating a pressure to force the ink from a small reservoir. Other methods for forcing the ink through the spray port are referred to as bubble jet and thermal jet techniques.

In ink printer systems, it is important to ensure clean delivery of the ink. If contamination clogs the spray ports, the operation of the ink cartridge is hindered. The flow of ink to the paper may be reduced and/or the plugged ports may drip.

The trend in the industry is to make the diameter of the spray ports even smaller to improve the resolution of the image produced. It has therefore become increasingly more important and difficult to filter out particles that may plug these smaller spray ports.

The most commonly used filter medium is a woven stainless steel screen. These screens can be made with a number of different strands per inch in order to create a pore size for filtration of particles larger than a predetermined size. For example, a screen having 250×1400 strands per inch (98×551 strands per cm) in a double Dutch twill weave, as available from Tetko Inc. will provide filtration for 19 micron nominal diameter and larger particles.

The screens used in these applications are typically stainless steel to ensure chemical compatibility with the ink. In most cases, the ink contains surfactants and/or solvents, as well as other compounds, to promote wetting of the paper or printing substrate. Furthermore, the inks may be acidic or basic.

One problem with stainless steel screens is that they are difficult to bond and seal to ink jet fluid throughputs. The filter material is typically heat staked to the plastic conduits/cavities of the print head base, and because of the irregular edges of the screen, a complete seal is difficult to produce. When cut into disc shapes, the woven screen has ragged edges that, if not sealed properly, can create a leak path for large particles to pass through. In some cases, the stainless steel screen is applied with an adhesive to ensure a good seal. However, this is a time consuming and costly process.

Further, the stainless steel screen can shed loose particles or fibers that can then contaminate or clog the spray ports. When the screen is cut, typically by die cutting, the overlapping metal strands can be pinched and broken. These small screen fragments can shed after the filter disc is adhered to the ink jet cartridge. If one of the shed strands gets downstream of the filter disc, it can clog the spray port head, creating problems with the printer.

SUMMARY OF THE INVENTION

The invention is directed to a multi-chamber inkjet print head that includes a plurality of individual print head ink chambers that share a common ink filter and are in fluid communication with an ink flow regulator. Likewise, the invention includes an associated method of assembling a print head base having at least two separate fluid conduit paths filtered by a single piece of filter and are in fluid communication with an ink flow regulator.

The flow regulator includes any type of ink regulator that controls the flow of ink between the regulator and one or more nozzles via backpressure. An exemplary ink flow regulator may include a pressurized chamber, generally exhibiting negative gauge pressure therewithin, having an ink flow inlet and an ink flow outlet. A seal is biased against the ink inlet to allow selective fluid communication between the interior of the pressurized chamber and an ink source. A flexible wall, acting as a diaphragm, is integrated with a chamber wall to selectively expand outwardly from and contract inwardly towards the interior of the chamber depending upon the relative pressure differential across the flexible wall. The pressure differential depends upon the pressure of the interior of the chamber verses the pressure on the outside of the flexible wall.

As the flexible wall of the regulator contracts inwardly towards the interior of the chamber, it actuates a lever. The lever includes a sealing arm and an opposing flexible arm, and pivots on a fulcrum. The sealing arm includes the seal biased against the ink inlet, while the flexible arm is angled with respect to the sealing arm and includes a spoon-shaped aspect contacting the flexible wall. As the flexible wall continues contracting inward, the flexible arm flexes without pivoting the lever until the force of the wall against the flexible arm is sufficient to overcome the bias biasing the sealing arm against the inlet. When the force against the lever is sufficient to overcome the bias, the lever pivots about the fulcrum to release the seal at the ink inlet, thereby allowing ink to flow into the chamber until the pressure differential is reduced such that the bias again overcomes the reduced push created by the inward contraction of the flexible wall.

It is a first aspect of the present invention to provide a method of securing at least one ink filter to at least two cavities operatively coupled to a print head base including the steps of: (a) positioning a single piece ink filter to span across at least two cavities operatively coupled to a print head base and adapted to supply a predetermined volume of ink to a plurality of nozzles associated with the print head base; and (b) welding the single piece ink filter to the two or more cavities. In a more detailed embodiment, a respective ink flow regulator is mounted in proximity to the single piece filter so as to be in fluid communication with each cavity. In another more detailed embodiment, a respective ink flow regulator is mounted to a filter cap that is mounted in proximity to the single piece filter such each cavity is in fluid communication with a respective ink flow regulator.

It is a second aspect of the present invention to provide a method of mounting a single piece ink filter to a print head base adapted to receive throughput of at least two different colored inks including the steps: (a) positioning a single piece filter between at least two separate ink receptacles associated with a print head and at least two respective ink conduits; and (b) sealing at least two respective ink paths between the two or more separate ink receptacles associated with the print head and the two or more ink conduits, such that the single piece of filter is in concurrent fluid communication with the two or more separate ink paths. In a more detailed embodiment, the single piece filter is shaped to be received within the two or more separate ink receptacles coupled to the print head. In another more detailed embodiment, an ink conduit extends from each of the two or more separate ink receptacles coupled to the print head. In an additional detailed embodiment, the two or more ink conduits include a filter cap having at least two respective individual inputs for at least two closed ink paths. In yet another detailed embodiment, the sealing step includes welding the two or more respective ink conduits to either the single piece filter or the print head base. In still a further detailed embodiment, the two or more separate ink receptacles include two or more respective recesses in the print head base.

It is a third aspect of the present invention to provide a multi-chamber inkjet print head having a plurality of individual print head ink chambers having a common ink filter. In a more detailed embodiment, the plurality of individual print head ink chambers are adapted to receive at least three colors of ink isolated from one another. In a more detailed embodiment, the plurality of individual print head ink chambers are each in fluid communication with a respective individual fluid regulator. In yet another detailed embodiment, an ink filter cap spans the plurality of individual print head ink chambers and is adapted to be operatively coupled to at least one of an ink source, the outlet of an ink regulator, and an ink conduit. In still a more detailed embodiment, a pressurized chamber includes (a) an ink inlet adapted to provide fluid communication with an ink source; (b) an ink outlet adapted to provide fluid communication with a print head; (c) at least one exterior flexible wall having an inner surface facing an interior of the pressurized chamber; (d) a lever including a first arm extending along a portion of the exterior flexible wall and an opposing arm operatively coupled to a seal, the seal closing the ink inlet when the lever is in a first position and to opening the ink inlet to allow fluid communication between the ink inlet and the pressurized chamber when the lever is pivoted to a second position, the lever being biased to the first position, where a higher pressure differential across the exterior flexible wall causes the exterior flexible wall to apply force against the first arm contacting the exterior flexible wall, overcoming the bias, to thereby pivot the lever to the second position, opening the ink inlet, where a lower pressure differential across the exterior flexible wall causes the force applied by the exterior flexible wall against the first arm contacting the exterior flexible wall to weaken, succumbing to the bias, which pivots the lever back to the first position, closing the ink inlet, and where a pressure change from the lower pressure differential to the higher pressure differential across the exterior flexible wall causes the force applied by the exterior flexible wall to increase without overcoming the bias.

DETAILED DESCRIPTION

Figure 1:
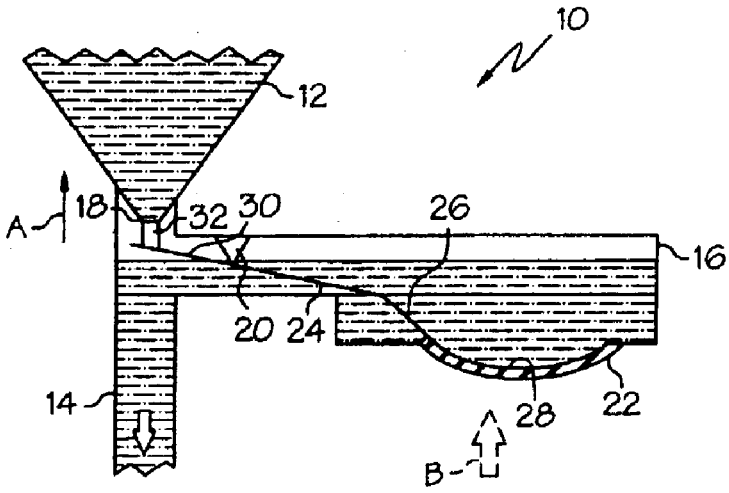
FIG. 1 is a cross-sectional, schematic, first stage representation of an exemplary embodiment of the present invention.

The exemplary embodiments of the present invention are described and illustrated below as ink regulators and/or ink cartridges (reservoirs) utilizing such regulators, for regulating the volumetric flow of ink between an ink source and a point of expulsion, generally encompassing a print head. The various orientational, positional, and reference terms used to describe the elements of the inventions are therefore used according to this frame of reference. Further, the use of letters and symbols in conjunction with reference numerals denote analogous structures and functionality of the base reference numeral. Of course, it will be apparent to those of ordinary skill in the art that the preferred embodiments may also be used in combination with one or more components to produce a functional ink cartridge for an inkjet printer. In such a case, the orientational or positional terms may be different. However, for clarity and precision, only a single orientational or positional reference will be utilized; and, therefore it will be understood that the positional and orientational terms used to describe the elements of the exemplary embodiments of the present invention are only used to describe the elements in relation to one another. For example, the regulator of the exemplary embodiments may be submerged within an ink reservoir and positioned such that the lengthwise portion is aligned vertically therein, thus effectively requiring like manipulation with respect to the orientational explanations.

Figure 2:
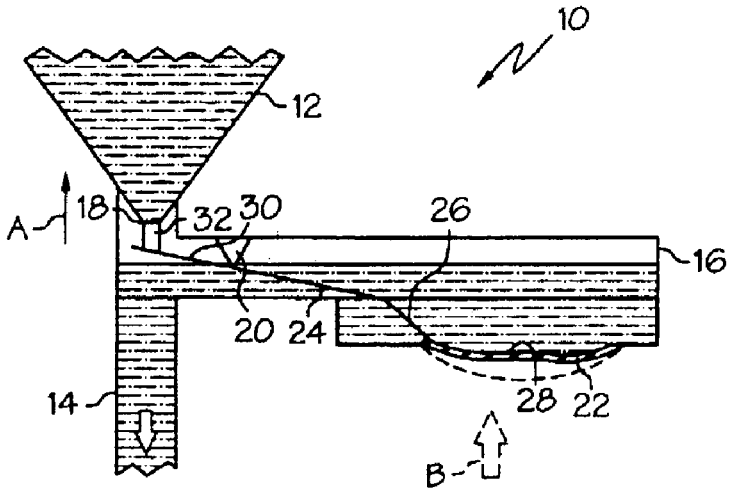
FIG. 2 is a cross-sectional, schematic, second stage representation of the exemplary embodiment of FIG. 1.
Figure 3:
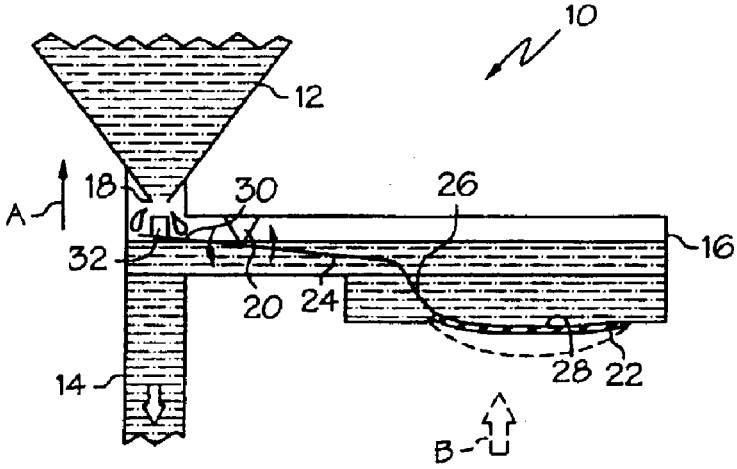
FIG. 3 is a cross-sectional, schematic, third stage representation of the exemplary embodiment of FIGS. 1 and 2.

As shown in FIGS. 1–3, an ink regulator 10 for regulating the volumetric flow of ink traveling between an ink source 12 and a print head in fluid communication with an ink outlet 14 generally includes: a pressurized chamber 16 including an ink inlet 18 in fluid communication with the ink source 12, the ink outlet 14 in fluid communication with the print head, and at least one flexible wall 22 or diaphragm; and a lever 24, pivoting on a fulcrum 20, including a flexible arm 26 having a spoon-shaped end 28 extending along a portion of the flexible wall 22 (diaphragm) and an opposing arm 30 operatively coupled to an inlet sealing member 32. The lever 24 is pivotable between a first position as shown in FIG. 1, in which the sealing member 32 presses against the ink inlet 18 to close the ink inlet, to a second position as shown in FIG. 3, in which the sealing member 32 is moved away from the ink inlet 18 to open the ink inlet and allow fluid communication between the ink inlet and the pressurized chamber 16. The lever 24 is biased (as shown by arrow A) to be in the first position, closing the ink inlet 18. The pressure within the pressurized chamber is set to be lower than that of the ambient pressure (shown by arrow B) outside of the flexible wall/diaphragm 22; and, as long as the ink inlet 18 remains closed, the pressure differential along the flexible wall will increase as ink flows through the outlet 14 to the print head. Consequently, a lower pressure differential across the flexible wall 22 causes the flexible wall 22 to expand/inflate and, thereby, pull the spoon-shaped end 28 of the flexible arm 26 contacting the flexible wall to pivot the lever 24 to the first position (closing the ink inlet in FIG. 1). Actually, the bias (represented by arrow A) causes the lever 24 to pivot when the flexible wall 22 no longer applies sufficient force against the spoon-shaped end 28 of the flexible arm to overcome the bias. A higher pressure differential across the flexible wall 22 causes the flexible wall to contract/deflate and, thereby, actuate the flexible arm contacting the flexible wall 22 so as to pivot the lever 24 to the second position (opening the ink inlet 18 as shown in FIG. 3), overcoming the bias (represented by arrow A). Also, when the pressure differential increases from the lower pressure differential to the higher pressure differential across the flexible wall 22 (resulting from ink flowing from the chamber 16 to the print head), the flexible wall 22 is caused to begin contracting/deflating and, thereby, actuate and flex the flexible arm 26 without causing the lever 24 to substantially pivot (as shown in FIG. 2).

The regulator will typically function in a cyclical process as shown in FIGS. 1–3. Referencing FIG. 1, the regulator is mounted to an ink outlet 14, such as a print head, and the inlet 18 is in fluid communication with an ink source 12. Generally, the contents of the chamber 16 will be under a lower pressure than the surrounding atmosphere (represented by Arrow B), thereby creating "back pressure" within the chamber 16. At this stage, the chamber 16 contains a certain amount of ink therein and the closed seal 32 prohibits ink from entering the chamber from the ink source 12, as the pressure differential across the flexible wall 22 is relatively low. The flexible wall 22 is in contact with the spoon-shaped end 28 of the lever's flexible arm 28. The lever is also biased (by a spring, for example) in this closed orientation.

Referencing FIG. 2, as ink continues to leave the chamber 16, the pressure within the chamber 16 begins to decrease, which, in turn, causes the pressure differential across the flexible wall 22 to increase (assuming the pressure on the outside of the flexible wall remains relatively constant). This increasing pressure differential causes the flexible wall 22 to begin to contract/deflate. Because the flexible wall 22 is in contact with the spoon-shaped end portion 28 of the lever's flexible arm 26, this contraction/deflation of the flexible wall causes the lever to flex, but not substantially pivot since the force of the flexible wall against the lever's flexible arm is not yet strong enough to overcome the bias.

Referencing FIG. 3, as ink continues to leave the chamber 16 and further increase the pressure differential across the flexible wall, the flexible wall 22 will contract/deflate to an extent that the inward pressure of the flexible wall against the flexible arm 26 of the lever overcomes the static force of the bias to pivot the lever 24 to its open position, thereby releasing the seal between the seal 32 and the ink inlet 18.

Thus, the bias and the properties of the lever enable the lever 24 to flex first, and thereafter when the amount of force applied to the lever is greater than the force applied by the spring to bias the lever closed, the lever pivots. This relatively high pressure differential between the contents of the chamber and the environment causes ink from the higher pressure ink source to pour into the chamber. The incoming volume of ink reduces the pressure differential such that the flexible wall expands outward from the chamber (inflating) to arrive again at the position as shown in FIG. 1, thus starting the three part cycle over again.

FIGS. 4–7 illustrate an exemplary embodiment of the regulator 10' for regulating volumetric flow of ink traveling between an ink source (not shown) and a print head in fluid communication with an ink outlet 14'. As introduced above, the regulator 10' includes a pressurized chamber 16' having an ink inlet 18' in fluid communication with the ink source and the ink outlet 14', which is in fluid communication with the print head (not shown). In this exemplary embodiment, the pressurized chamber 16' is formed by an injection molded base 34 having a floor 36, a pair of elongated opposing side walls 38 and a pair of elongated opposing end walls 40 which collectively form a generally rectangular top opening bounded by the four interior walls. The elongated side walls each include a pair of vertical ribs forming a bearing seat for receiving bearing pins 42 of the lever 24', thereby forming the lever's fulcrum 20'.

The floor 36 includes a generally cylindrical orifice forming the ink outlet 14' and a generally oval orifice 44 over which the flexible wall/diaphragm 22' is mounted. A pair of perpendicular, diametrical spring supports 46 (forming a cross) are positioned within the cylindrical channel of the outlet 14', where the central hub of the cross formed by the pair of diametrical supports 46 extends upwardly to form an axial projection for seating a spring 50 thereabout. Circumferentially arranges gaps 49 between the supports 46 provide fluid communication between the chamber 16' and the ink outlet 14' (see FIG. 5). The spring 50 provides the bias represented by arrow A in FIGS. 1–3.

Figure 4:
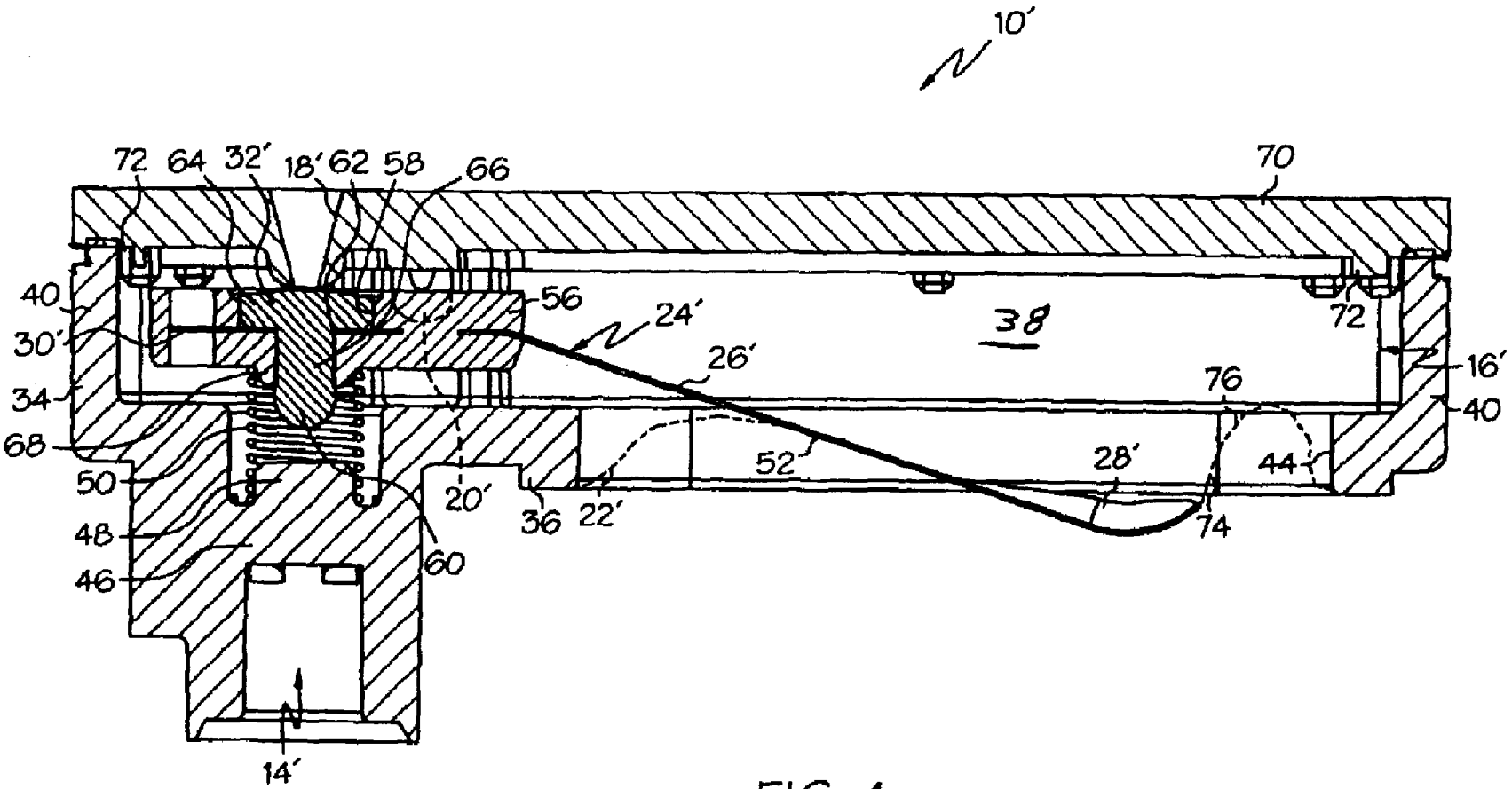
FIG. 4 is an elevational, cross-sectional view of an exemplary embodiment of the present invention.
Figure 5:
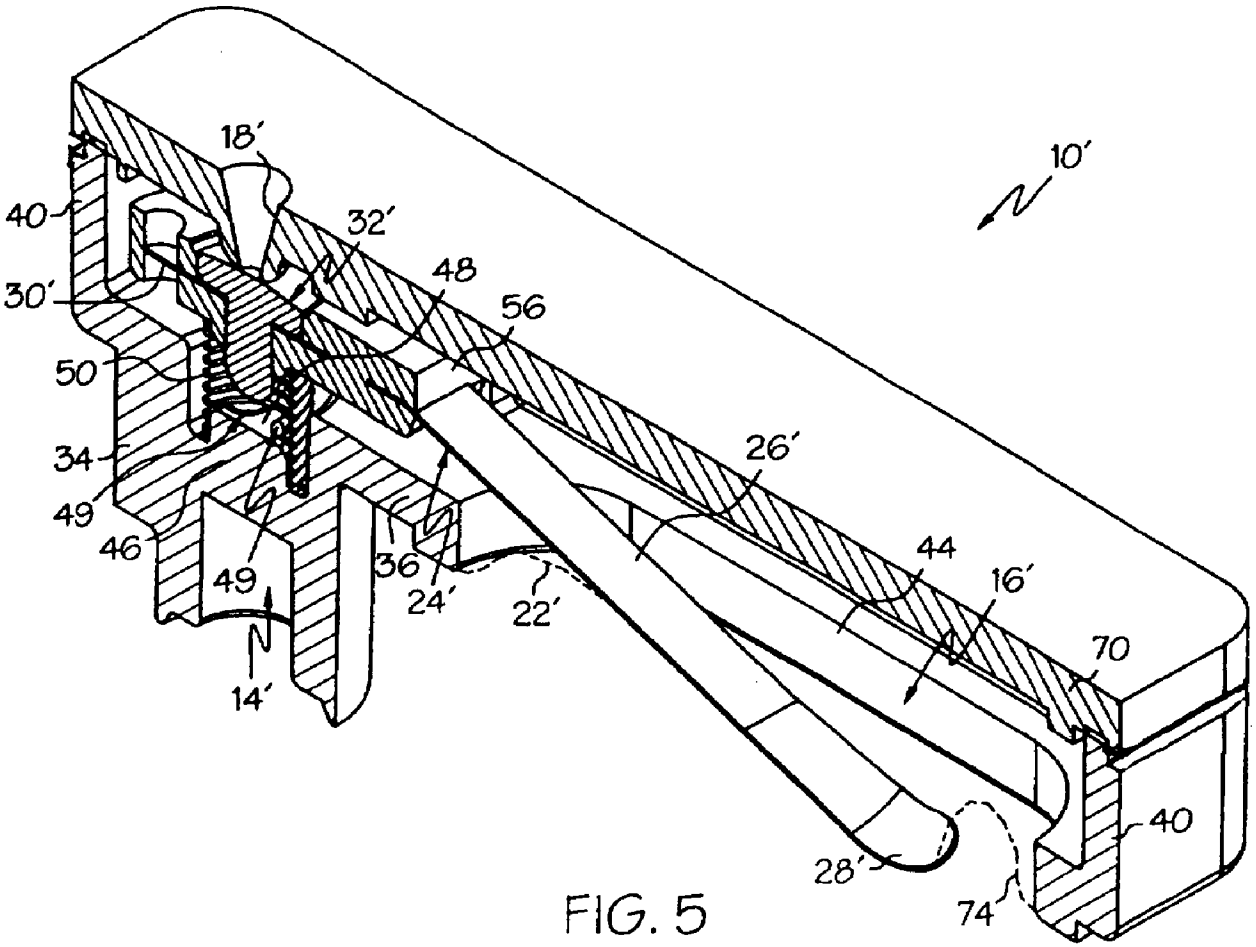
FIG. 5 is perspective, cross-sectional view of the exemplary embodiment of FIG. 4.
Figure 6:
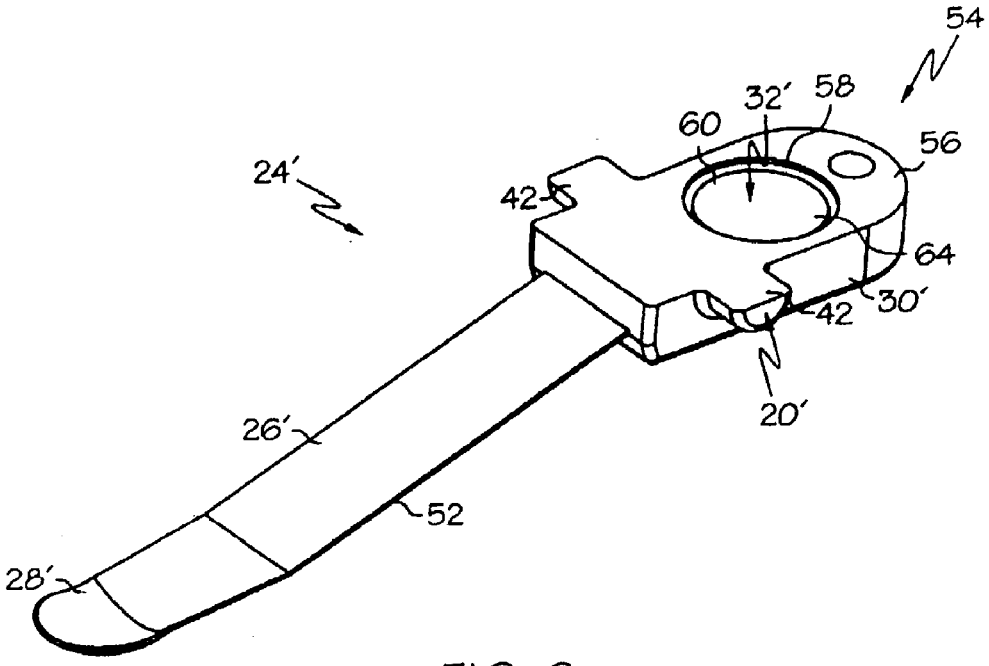
FIG. 6 is an overhead perspective view of a lever component of the embodiments of FIGS. 4 and 5.
Figure 7:
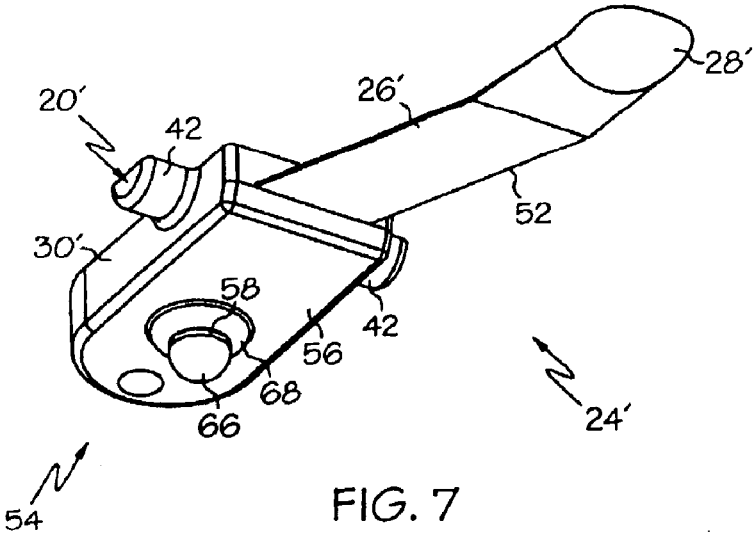
FIG. 7 is an underneath perspective view of the lever component of FIG. 6.

The lever 24' includes a strip of spring metal 52 with a spoon-shaped first end 28' and an encapsulated second end 54. The spoon-shaped end 28' is angled with respect to the encapsulated end 54. The encapsulated end 54 is encapsulated by a block 56 of plastic material where the block 56 includes the pair of bearing pins 42 extending axially outward along the pivot axis of the fulcrum 20'; and also includes a counter-bored channel 58 extending therethrough for seating an elastomeric sealing plug 60 therein. The strip 52 of spring metal also includes a hole 62 extending therethrough that is concentric with the channel 58 in the encapsulated body 56 for accommodating the sealing plug 60. The plug 60 includes a disk-shaped head 64 and an axial stem 66 extending downwardly therefrom. As can be seen in FIG. 4, the plug 60 is axially aligned with the spring 50, and the encapsulated body 56 is seated within the spring 50 by a dome-shaped, concentric projection 68 extending downwardly from the encapsulated body. The spring metal construction of the strip 52 provides the flexibility of the arm 26' described above with respect to FIGS. 1–3.

The base 34 is capped by a plastic lid 70 having a generally rectangular shape matching that of the rectangular opening formed by the elongated side walls 38 and end walls 40 of the base 34. The lid 70 has a generally planar top surface with the exception of a generally conical channel extending there through to form the inlet 18' of the pressurized chamber 16'. The lower side of the lid 70 includes a series of bases or projections 72 for registering the lid on the base 34. In an alternate embodiment, the lid may include a cylindrical tube (coupled to element 71 of FIG. 8, for example), aligned with the inlet 18' forming a hose coupling. The lid 70, of course, is mounted to the body 34 to seal the chamber 16' there within.

The flexible wall 22' is preferably a thin polymer film attached around the outer edges of the oval opening 44 extending through the floor 36 of the base 34. The area of the film 22' positioned within the opening 44 is larger than the area of the opening 44 so that the flexible film 22' can expand outwardly and contract inwardly with the changes of the pressure differential between the pressurized chamber 16' and the outer surface 74 of the film (where the pressure on the outer surface 74 of the film may be ambient pressure, pressure of ink within and ink reservoir, etc.).

Assembly of the regulator includes providing the base 34; positioning the spring 50 on the seat 48; positioning the pins 42 of the lever 24' within the bearing seats formed in the elongated side walls 38 of the base 34 and seating the dome 68 on the spring 50 such that the spoon-shaped end 28' of the lever contacts the inner surface 76 of the flexible wall 22'; and mounting the lid 70 thereover so as to seal the pressurized chamber 16 therein. Operation of the regulator 10' is as described above with respect to the regulator 10 of FIGS. 1–3.

Figure 8:
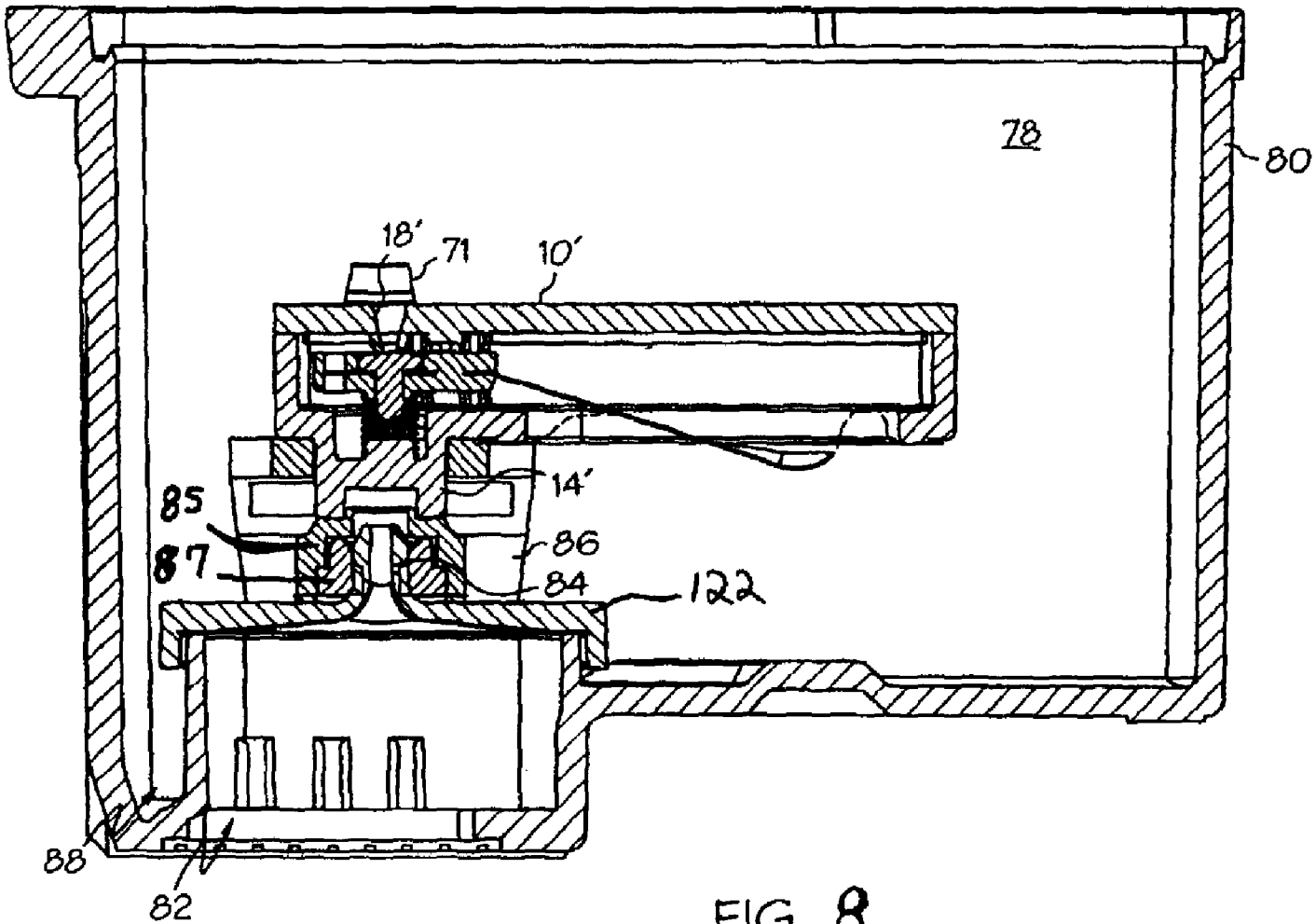
FIG. 8 is an elevational, cross-sectional view of the embodiment similar to the embodiments of FIGS. 4–7 mounted within an ink cartridge.
Figure 9:
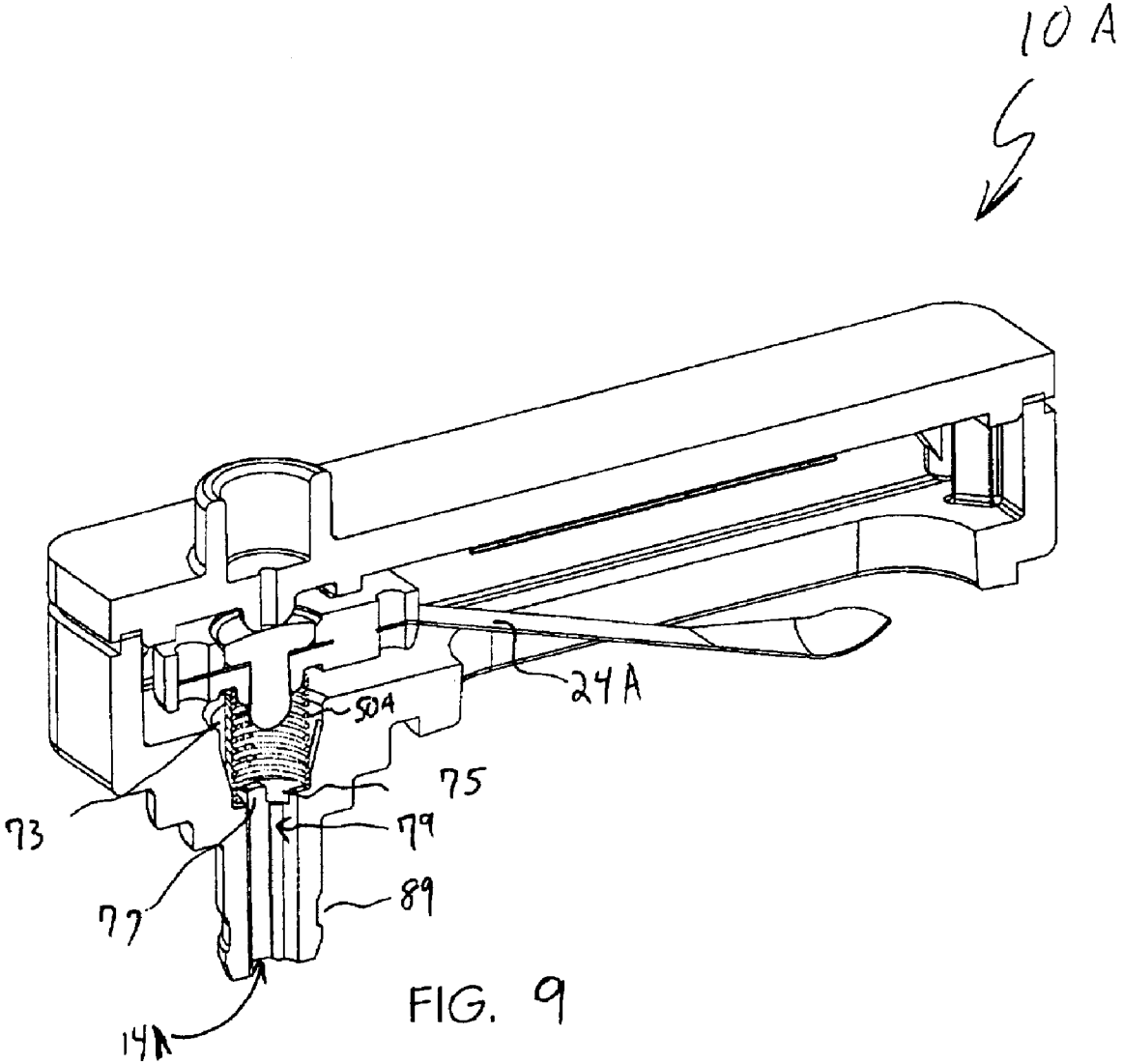
FIG. 9 is an elevated perspective, cross-sectional view of the exemplary embodiment of FIG. 10.
Figure 10:
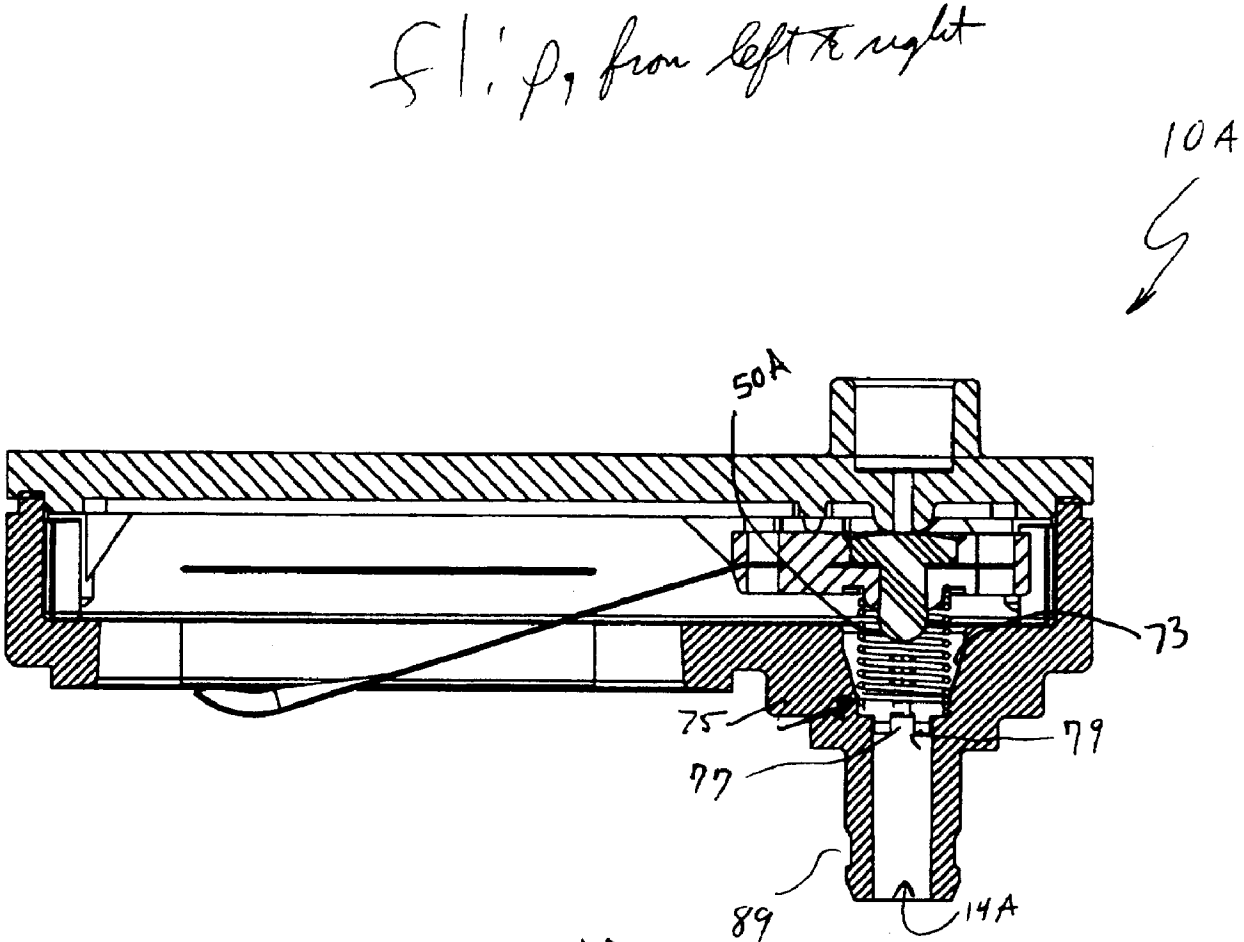
FIG. 10 is a cross-sectional view of an additional exemplary embodiment of the present invention.
Figure 11:
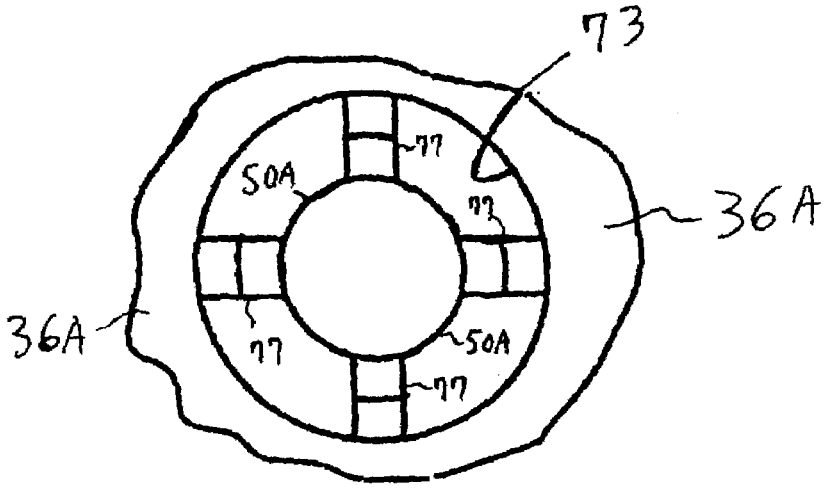
FIG. 11 is an isolated overhead view of the ink outlet of the embodiments of FIGS. 9 and 10.
Figure 12:
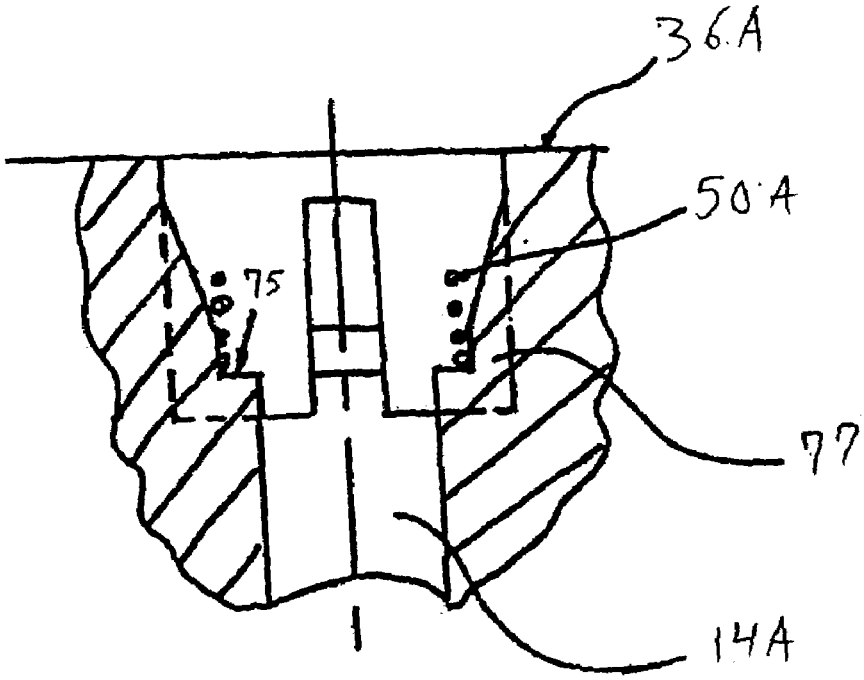
FIG. 12 is an isolated cross-sectional view of the ink outlet of the embodiments of FIGS. 9 and 10.

As shown in FIG. 8, the regulator 10' may be mounted within an ink reservoir 78 of an ink cartridge 80, having a print head 82. The outlet 14' of the regulator 10' is coupled to an inlet 84 of the ink filter cap 122 (that is operatively coupled to the print head 82) by an adapter 85. The adapter 85 is mounted to the regulator outlet 14' and circumscribes a seal 87 that provides a fluidic seal between the adapter 85 and the ink filter cap 122. An collar 86 circumscribes the adapter 85 for additional support. A siphon hose (not shown) provides fluid communication between the lowest point 88 of the reservoir 78 and the hose coupling 71, which is in fluid communication with the regulator's ink inlet 18'. In this embodiment, pressure provided against the outer surface 74 of the flexible wall 22' will be the pressure within the ink reservoir 78.

FIGS. 9–12 illustrate another exemplary embodiment of the regulator 10A for regulating the volumetric flow of ink traveling between an ink source (not shown) and a print head (not shown) in fluid communication with an ink outlet 14A. The regulator 10A includes a majority of the same structural features of the regulator 10' (See FIGS. 4 and 5) discussed above, and may utilize the same lever mechanisms as described above (See FIGS. 6 and 7). However, the regulator 10A of this exemplary embodiment includes a cylindrical opening 73 in the floor 36A in fluid communication that abuts a smaller diameter cylindrical ink outlet 14A (smaller with respect to the cylindrical opening 73), thereby allowing throughput of ink from the pressurized chamber 16A by way of the ink outlet 14A.

The cylindrical opening 73 in the floor 36A includes a spring seat 75 for seating the lower portion of the spring 50A therein. The spring seat 75 includes a plurality of protrusions extending outward from the walls of the cylindrical opening 73 that provide substantially L-shaped ribs 77 (four in this exemplary embodiment) in elevational cross-section. The vertical portion of the L-shaped ribs 77 tapers and transitions inward toward the interior walls to provide a relatively smooth transition between the rib surfaces potentially contacting the spring 50A and the interior walls of the cylindrical opening 73. The horizontal portion of the L-shaped rib 77 provides a plateau upon which the spring 50A is seated thereon. The tapered portions of the ribs 77 work in conjunction to provide a conical guide for aligning the spring 50*a* within the spring seat 75.

In assembling this exemplary embodiment, the tapered portion of the L-shaped ribs 77 effectively provides a conical guide for aligning the spring 50A within the spring seat 75. In other words, the L-shaped ribs 77 within the cylindrical opening 73 provides ease in assembly as the spring 50A is placed longitudinally approximate the throughput 79 and becomes gravitationally vertically aligned within the opening 73, thereby reducing the level of precision necessary to assembly this exemplary embodiment.

Figure 13:
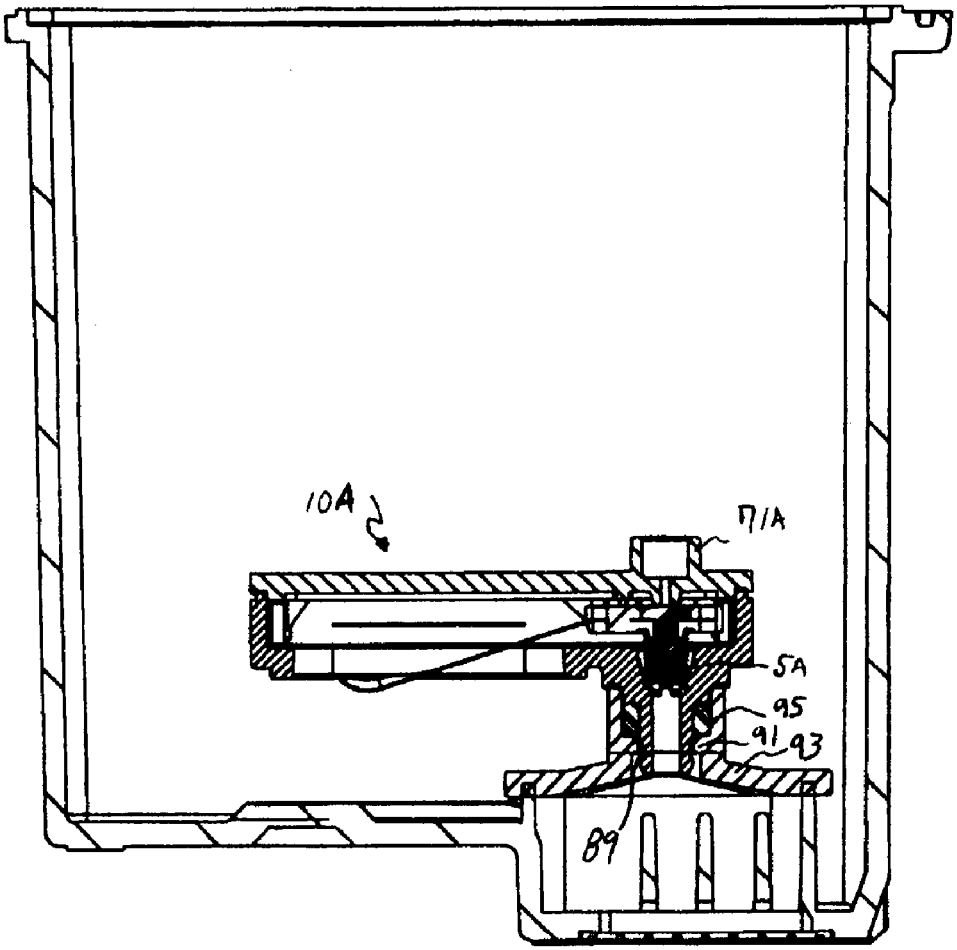
FIG. 13 is an elevational, cross-sectional view of the embodiment similar to the embodiments of FIGS. 9 and 10 mounted horizontally within an ink cartridge.
Figure 14:
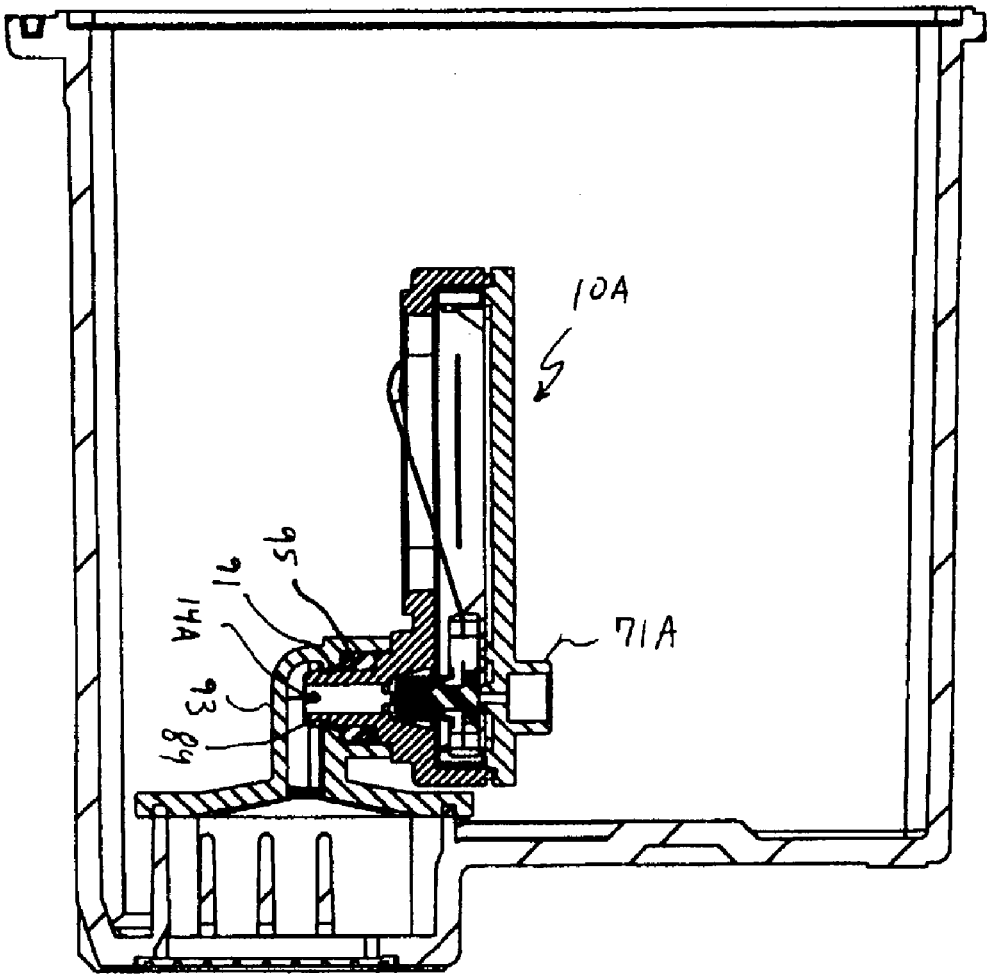
FIG. 14 is an elevational, cross-sectional view of the embodiment similar to the embodiments of FIGS. 9 and 10 mounted vertically within an ink cartridge.

As shown in FIGS. 13–14, the regulator 10A may be mounted within an ink reservoir 78A of an ink cartridge 80A operatively coupled to a print head 82A. The ink outlet 14A of the regulator 10A includes an annular groove 89 on the outer circumferential surface of the outlet stem that is adapted to mate with a corresponding annular protrusion 91 of an adapter 93 to provide a snap fit therebetween. The adaptor 93 extends from, or is coupled to the inlet of the print head 82. The above-described coupling mechanism can thus be used to orient the regulator 10A in a generally vertical manner as shown in FIG. 14, or a generally horizontal manner as shown in FIG. 13. To ensure a sealed fluidic interface is provided between the outlet 14A of the regulator 10A and the adapter 93, an O-ring 95 or analogous seal is circumferentially arranged about the ink outlet 14A radially between the outlet stem and the adaptor 93. Upon snapping the regulator 10A into place so that the annular groove 89 receives the protrusion 91 of the adapter 93, the O-ring 95 is compressed, resulting in a radial compression seal between the adapter 93 and the ink outlet 14A.

A siphon hose (not shown) may be operatively coupled to the ink inlet 18A to by way of the hose coupling 71A to provide fluid communication between a lower ink accumulation point 88A of the reservoir 78A and the ink inlet 18A. While the above exemplary embodiments have been described and shown where the coupling adapter 93 is integrated into, and functions concurrently as a filter cap for the print head 82, it is also within the scope and spirit of the present invention to provide an adapter that is operatively mounted in series between a filter cap of the print head 82 and the regulator 10A.

Figure 15:
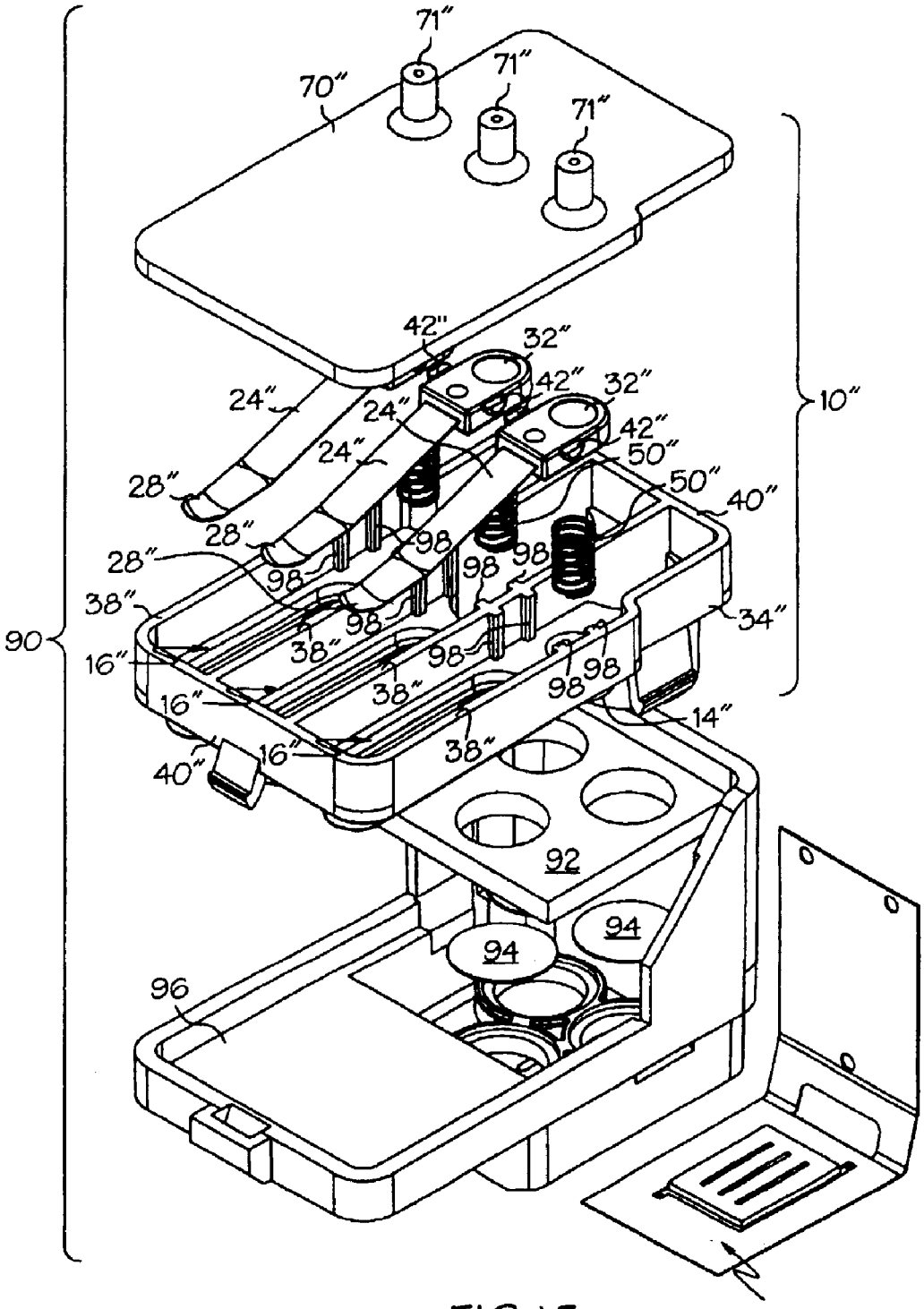
FIG. 15 is a perspective, exploded view of another embodiment of the present invention representing an ink cartridge with multiple ink reservoirs and respective ink regulators according to the present invention provided therein.

As shown in FIG. 15, another second exemplary embodiment of the present invention representing a multi-color print head assembly 90 with three ink sources (not shown) and three respective ink regulators 10" for controlling the volumetric flow of colored inks from the respective ink sources to the tri-color print head 92. Generally, a simple three-color print head will include ink sources comprising yellow colored ink, cyan colored ink, and magenta colored ink. However, it is within the scope of the present invention to provide multi-color print head assemblies having two or more ink sources, as well as single color print head assemblies. Thus, this exemplary embodiment provides a compact regulation system accommodating multi-color printing applications. For purposes of brevity, reference is had to the previous exemplary embodiments as to the general functionality of the individual regulators 10".

The print head assembly 90 includes a multi-chamber body 34", a top lid 70" having three inlet hose couplings 71" for providing fluid communication with the three ink sources, three levers 24", three springs 50", a seal 92, three filters 94, a nose 96, and the tri-color print head heater chip assembly 101. Each chamber 16" is generally analogous to the chamber described in the previous exemplary embodiments. FIG. 15 provides a view of the vertical ribs 98 provided on the elongated side walls 38", and optionally on the underneath side of the top lid 70", providing the bearing seats for the bearing pins 42" of the levers 24" as discussed above with respect to the above exemplary embodiments. Further, each chamber includes internal bearing seats, an opening accommodating inward movement of the flexible wall (not shown), and a spring guide (not shown). Likewise, each lever 24" is analogous to that described in the above exemplary embodiment.

Figure 16:
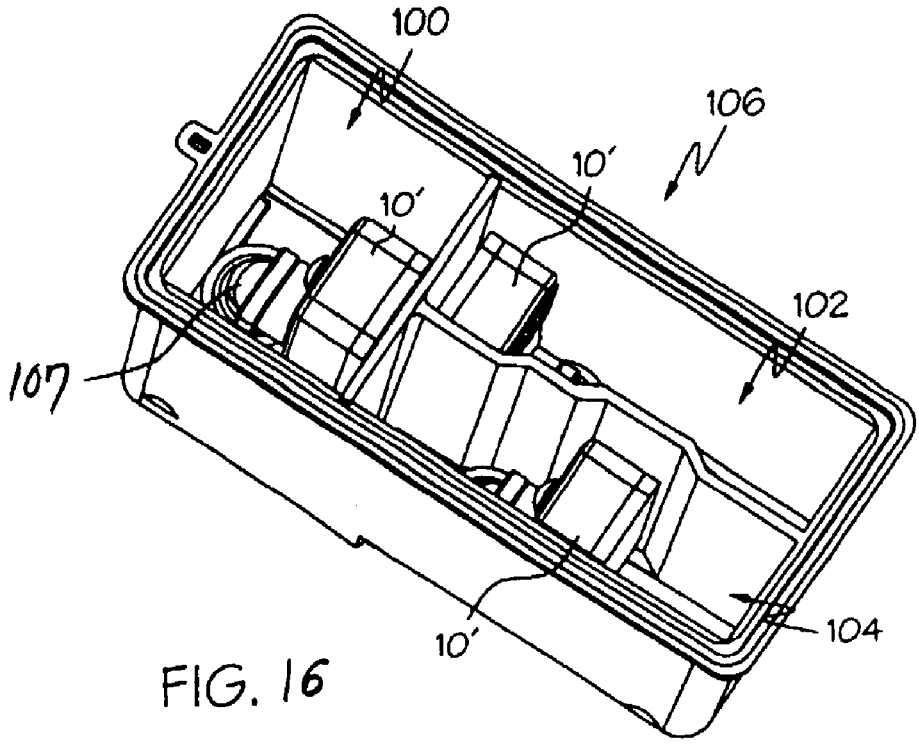
FIG. 16 is a perspective overhead view of another embodiment of the present invention representing an ink cartridge with multiple ink reservoirs and respective ink regulators according to the present invention provided therein.
Figure 17:
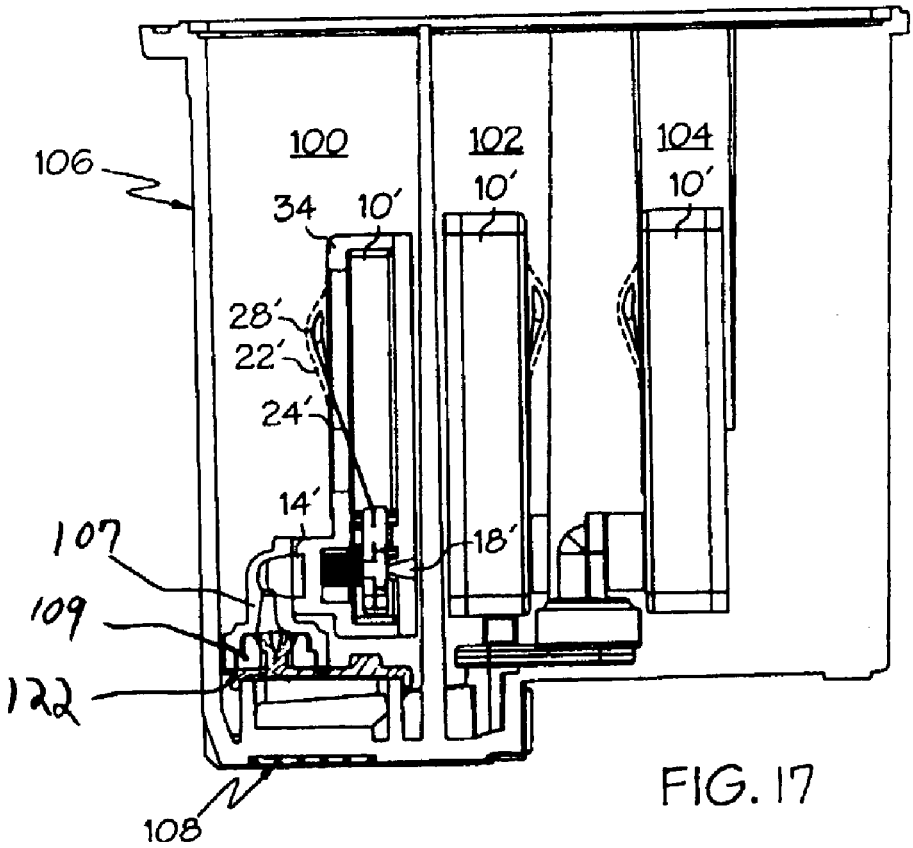
FIG. 17 is an elevational, cross-sectional view of the embodiment of FIG. 16.

Referencing FIGS. 16 and 17, three of the regulators 10' are housed within respective ink reservoirs 100, 102 and 104 contained within a multi-color printer ink cartridge 106. The regulators 10' are generally oriented in a vertical fashion with the ink inlets 18' and ink outlets 14' positioned toward the bottom of the respective reservoirs, and the spoon-shaped ends 28' of the levers 24' directed upwards. Each of the regulators 10' includes an adapter 107 that mounts the outlet 14' of the regulator to the filter cap 122. The ink filter cap 122 is operatively coupled to the print head 108. Each adapter 107 circumscribes a seal 109 that maintains a sealed fluidic interface between the outlet 14' of the regulator and the inlet 84 of the ink filter cap 122. In such an arrangement it is possible for each of the three respective regulators to function independently of one another, and thus, the fluid level within one of the respective reservoirs has no bearing upon the functional nature of the regulators in the opposing reservoirs. It should also be noted that each of the regulators may include a siphon/hose providing fluid communication between the fluid inlet 18' and the floor of the respective fluid reservoirs, such that the lower pressure within the fluid regulator is able to draw in almost all of the fluid within a respective chamber. Each of the respective reservoirs provides an individual fluid conduit to the multi-color print head 108 while functioning independent of whether or not the respective regulator is submerged completely within ink, partially submerged within ink or completely surrounded by gas. It should also be understood that this exemplary embodiment could easily be adapted to provide two or more individual fluid reservoirs by simply isolating each respective reservoir having its own individual fluid regulator contained therein and operatively coupled to the regulator such that the ink flow from the reservoir must be in series or must go through the regulator before exiting the respective reservoir.

Figure 18:
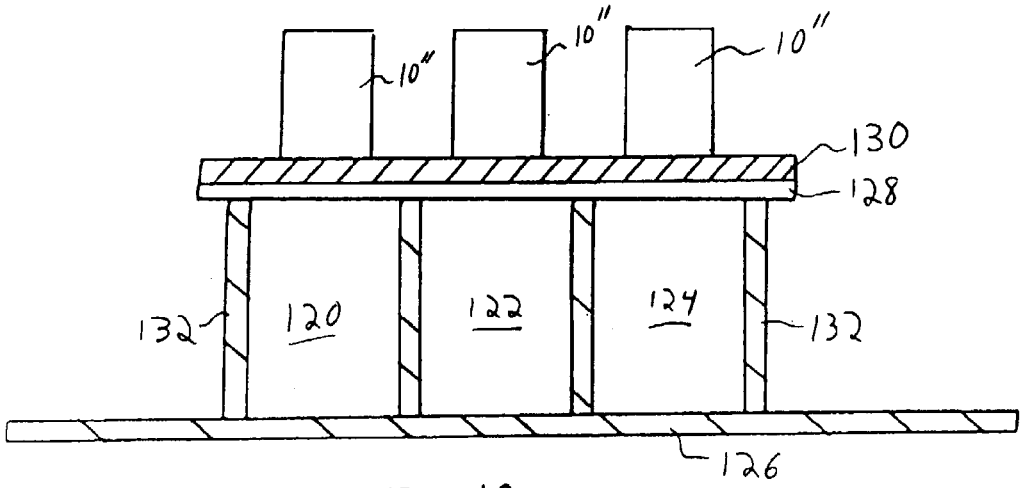
FIG. 18 is a cross-sectional view of an exemplary embodiment in accordance with the present invention incorporating a single piece ink filter.

As shown in FIG. 18, the fluid regulator 10" of the present invention may be in positioned to be in fluid communication with one or more ink chambers 120, 122, 124 associated with the print head base 126 that are in fluid communication with one or more nozzles (not shown) to regulate the flow of ink between the fluid regulator 10" and the point at which the ink is ejected from the nozzles. In this exemplary embodiment, a single piece of filter material 128 spans more than one of the individual chambers 120, 122, 124 to provide filtration of the ink between the ink regulator 10" and the individual chambers without necessitating individual ink filters associated with each chamber. Assembly of this exemplary embodiment includes heating the walls 132 and pushing the single piece of filter 128 downward into the walls 132 of the print head base 126 to seat the ink filter within the walls. It is preferred to seat the ink filter 128 within the walls such that the wall material seeps through the ink filter 128 and encapsulates the ink filter forming a wetting ring on top of the ink filter. The fluid regulators 10" or a gasket 130 may be mounted to this wetting ring to provide a sealed fluid interface. In either instance, a sealed fluid system may be attained.

Figure 19:
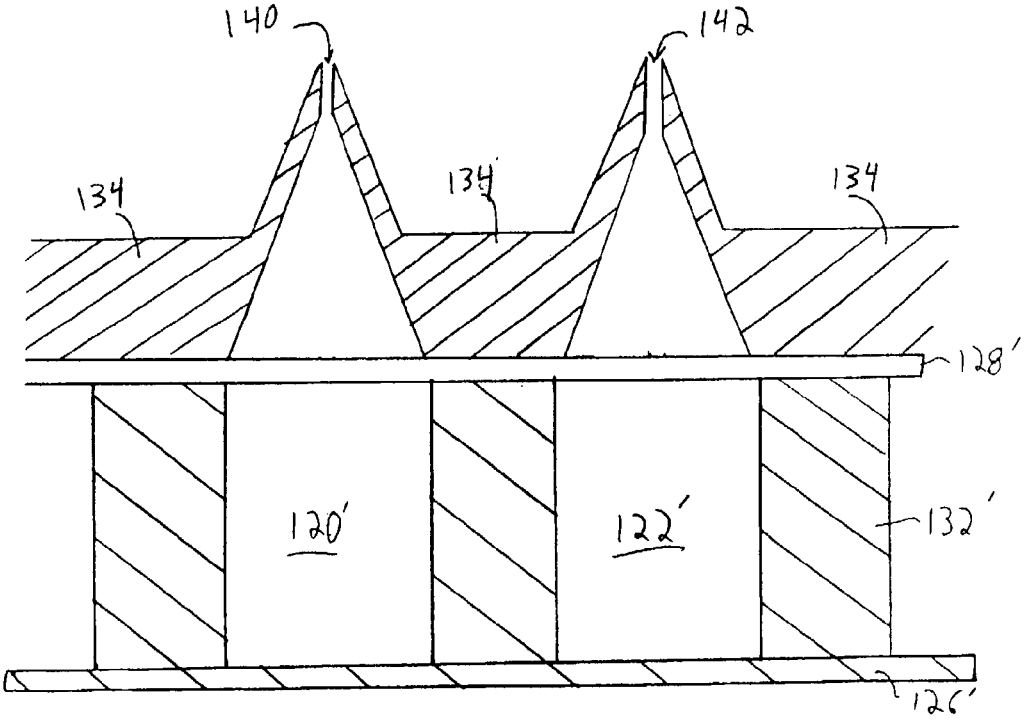
FIG. 19 is a cross-sectional view of an alternate exemplary embodiment incorporating a single piece ink filter.

Referencing FIG. 19, an alternate exemplary embodiment, includes an ink filter cap 134 sandwiching the single piece of filter material 128' between the walls 132' of the print head base 126'. In this alternate exemplary embodiment, the ink filter cap 134 is seated upon a wetting ring formed as a result of pressing the single piece of filter material 128' on top of the walls 132' of the respective ink chambers 120', 122' associated with the print head base 126'. As stated above, the wetting ring (not shown) provides a fluidic seal interface for the filter cap 134 to be bonded thereto to exclude fluid contamination across the respective fluid inlets 140, 142 representing generally a two color system.

It is also within the scope and spirit of the present invention to mount one or more of the individual fluid regulators 10" of FIG. 18 to the respective ink inlets 140, 142 of the ink filter cap 134. It is further within the scope and spirit of the present invention to sandwich the gasket 130 between the fluid regulators 10" and the ink filter cap 134. Likewise, it is within the scope of the invention to provide more than two fluid inlets. It is even further within the scope and spirit of the present invention for the gasket 130 to include O-rings that may be compressed in a radial and/or an axial direction.

It is also within the scope and spirit of the present invention to omit the one or more of the individual fluid regulators 10" of FIG. 18 and provide one or more ink reservoirs being in fluid communication with the respective ink inlets 140, 142, 144 of the ink filter cap 134. Such ink reservoirs may include foam regulators or be operatively coupled to other pressure manipulation sources.

The single piece filter invention may utilize a laser welding process that simplifies the machining and process steps by which filters are attached to the print head base, print head cartridge, or ink cartridge. Aligning a single component, as opposed to multiple components attributable to each ink chamber, brings about such a simplification in the size of each filter alone. Likewise, the single piece filter invention may make use of a technique, laser welding, which is capable of orienting the respective components to be bound together before the very bonding has started to occur. Still further, the single piece filter is less expensive to produce and less complicated to assemble than prior art counterparts.

Following from the above description and invention summaries, it should be apparent to those of ordinary skill in the art that, while the methods and apparatuses herein described constitute exemplary embodiments of the present invention, the inventions contained herein are not limited to these precise embodiments and that changes may be made to them without departing from the scope of the inventions as defined by the claims. Additionally, it is to be understood that the invention is defined by the claims and it is not intended that any limitations or elements describing the exemplary embodiments set forth herein are to be incorporated into the meanings of the claims unless such limitations or elements are explicitly listed in the claims. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A method of securing at least one ink filter spanning across at least two cavities operatively coupled to a print head base comprising:

positioning a single piece ink filter to span across the at least two cavities formed in a conduit structure operatively coupled to a the print head base that are adapted to supply a predetermined volume of ink to a plurality of nozzles associated with the print head base;

securing the single piece ink filter to span across the at least two cavities; and mounting an ink filter cap to the conduit structure to provide at least two isolated ink flow paths through the ink filter cap and the conduit structure upon completion of the mounting act.

2. The method of claim 1, wherein each of the at least two isolated ink flow paths of the ink filter cap are adapted to be in fluid communication with an ink flow regulator.

3. The method of claim 2, wherein each of the at least two isolated ink flow paths of the ink filter cap include an ink inlet mounted to the ink flow regulator, wherein at least one of the ink filter cap and the ink flow regulator include a seal to provide exclusive fluid communication between an outlet of the ink flow regulator and the inlet of the ink filter cap.

4. The method of claim 3, wherein the seal includes a compression seal.

5. The method of claim 4, wherein the compression seal includes an O-ring.

6. A multi-chamber inkjet print head comprising a plurality of ink reservoirs and an ink filter mounted to and spanning across a plurality of outlet conduits of the plurality of ink reservoirs upstream from a print head chip, wherein each of the plurality of reservoirs is in fluid communication with an ink flow regulator, wherein each ink flow regulator comprises:

a pressurized chamber including an ink inlet adapted to provide fluid communication with an ink source, an ink outlet adapted to provide fluid communication with a print head, and at least one exterior flexible wall having an inner surface facing an interior of the pressurized chamber; and a lever including a flexible arm extending along a portion of the exterior flexible wall and an opposing arm operatively coupled to a seal, the seal closing the ink inlet when the lever is in a first position and to opening the ink inlet to allow fluid communication between the ink inlet and the pressurized chamber when the lever is pivoted to a second position, the lever being biased to the first position;

wherein a higher pressure differential across the exterior flexible wall causes the exterior flexible wall to apply force against the flexible arm contacting the exterior flexible wall, overcoming the bias, to thereby pivot the lever to the second position, opening the ink inlet;

wherein a lower pressure differential across the exterior flexible wall causes the force applied by the exterior flexible wall against the flexible arm contacting the exterior flexible wall to weaken, succumbing to the bias, which pivots the lever back to the first position, closing the ink inlet; and wherein a pressure change from the lower pressure differential to the higher pressure differential across the exterior flexible wall causes the force applied by the exterior flexible wall to increase and flex the flexible arm without overcoming the bias.

7. A multi-chamber inkjet print head comprising a plurality of ink reservoirs and an ink filter mounted to and spanning across a plurality of outlet conduits of the plurality of ink reservoirs upstream from a print head chip, wherein each of the plurality of reservoirs is in fluid communication with an ink flaw regulator, wherein each ink flow regulator comprises:

a pressurized chamber including an ink inlet adapted to provide fluid communication with an ink source, an ink outlet adapted to provide fluid communication with a print head, and at least one exterior flexible wall having an inner surface facing an interior of the pressurized chamber; and a lever including a first arm extending along a portion of the exterior flexible wall and an opposing arm operatively coupled to a seal, the seal closing the ink inlet when the lever is in a first position and to opening the ink inlet to allow fluid communication between the ink inlet and the pressurized chamber when the lever is pivoted to a second position, the lever being biased to the first position;

wherein a higher pressure differential across the exterior flexible wall causes the exterior flexible wall to apply force against the first arm contacting the exterior flexible wall, overcoming the bias, to thereby pivot the lever to the second position, opening the ink inlet;

wherein a lower pressure differential across the exterior flexible wall causes the force applied by the exterior flexible wall against the first arm contacting the exterior flexible wall to weaken, succumbing to the bias, which pivots the lever back to the first position, closing the ink inlet; and wherein a pressure change from the lower pressure differential to the higher pressure differential across the exterior flexible wall causes the force applied by the exterior flexible wall to increase without overcoming the bias.

* * * * *